United States Patent [19]

Miller

[11] 4,145,277

[45] Mar. 20, 1979

[54] DENITRIFICATION BY FURFURAL-FERRIC CHLORIDE EXTRACTION OF A HYDRODESULFURIZED HYDROCARBONACEOUS OIL

[75] Inventor: Stephen J. Miller, Emeryville, Calif.

[73] Assignee: Chevron Research Company, San Francisco, Calif.

[21] Appl. No.: 913,407

[22] Filed: Jun. 7, 1978

[51] Int. Cl.[2] ..... C10G 21/16; C10G 23/00

[52] U.S. Cl. ..... 208/212; 208/254 R

[58] Field of Search ..... 208/212, 254 R

[56] References Cited

U.S. PATENT DOCUMENTS

| | | | |
|---|---|---|---|
| 2,796,387 | 6/1957 | Schmidt | 208/254 R |
| 2,800,427 | 7/1957 | Junk, Jr. et al. | 208/254 R |
| 2,846,358 | 8/1958 | Bieber et al. | 208/212 |
| 3,193,496 | 7/1965 | Hartung | 208/212 |
| 3,201,345 | 8/1965 | Hamilton et al. | 208/212 |

*Primary Examiner*—George Crasanakis

*Attorney, Agent, or Firm*—D. A. Newell; R. H. Davies; D. L. Hagmann

[57] ABSTRACT

A process is disclosed for upgrading a hydrodesulfurized hydrocarbonaceous oil by extracting residual nitrogen-containing impurities from a sulfur-reduced oil. A furfural solution containing a minor amount of ferric chloride is contacted with the oil under liquid-liquid extracting conditions, including a 0 to 50° C. temperature and an 0.1–5 solution-to-oil volume ratio.

9 Claims, No Drawings

DENITRIFICATION BY FURFURAL-FERRIC CHLORIDE EXTRACTION OF A HYDRODESULFURIZED HYDROCARBONACEOUS OIL

BACKGROUND OF THE INVENTION

This invention relates to upgrading a hydrodesulfurized hydrocarbonaceous oil. More particularly, a sulfur-reduced oil containing residual nitrogen-containing impurities is upgraded by extracting a major portion of these impurities from the oil using a furfural solution of ferric chloride.

In upgrading hydrocarbon feedstocks contaminated by sulfur- and nitrogen-containing impurities, it is often impractical to simultaneously reduce the content of each of these impurities to a satisfactory level. The ease of their removal varies greatly depending upon such factors as the kind, amount and the like of impurity involved. Conditions sufficiently severe to insure effective removal of both kinds of impurities often are undesirably costly in terms of reduced yields of desired products because of excessive cracking. Usually a satisfactory sulfur content for the treated oil is achieved but the residual nitrogen content is excessive. Further treatment, for example with a more nitrogen-impurity-selective catalyst, is one solution to the problem. However, added process costs for catalyst, hydrogen and the like are appreciable. Consequently, there is a need for a relatively inexpensive means for removing residual nitrogen-containing impurities from a hydrodesulfurized hydrocarbonaceous oil.

An object of this invention is to provide an effective process for removing residual nitrogen-containing impurities from a hydrodesulfurized oil.

Other objects will become apparent to skilled persons in this art from the following examples and description of the invention.

SUMMARY OF THE INVENTION

In accordance with the present invention, an improved process is provided for (1) upgrading a hydrodesulfurized hydrocarbonaceous oil contaminated by residual nitrogen-containing impurities, calculated as nitrogen, in an amount in the range below about 1000, preferably 10 to 1000, ppmw wherein at least a fraction of the oil is contacted with a solution of ferric chloride, said contacting being under liquid-liquid extracting conditions, including (a) a temperature in the range of from about 0° to 50° C. (preferably 10°–40° C.), and (b) a solution-to-oil volume ratio in the range of from about 0.1 to 5, said solution containing (i) at least a major portion of furfural solvent and (ii) said ferric chloride in an amount by weight, based upon the solution, in the range of from about 0.001 to 10 percent, thereby forming a raffinate oil phase containing a minor portion of said nitrogenous impurity; and (2) withdrawing said raffinate oil phase from step (1).

In a particular and preferred aspect of the invention, a sulfur-reduced vacuum gas oil is upgraded for use as fuel for furnaces.

By "hydrocarbonaceous oil" as used herein is meant, by definition, normally liquid hydrocarbon mixtures typically obtained by known methods, for example, in petroleum refining.

By "hydrocarbon hydrodesulfurizing conditions" as used herein is meant, by definition, the contacting of a typical sulfurcontaminated feed with a typical catalyst composite comprising a refractory oxide support component and at least one hydrogenating component selected from the group consisting of the metals, oxides and sulfides of the metallic elements of Groups VIB and VIII of the Periodic Chart of the Elements, said contacting being under typical hydrodesulfurizing conditions including (1) a temperature in the range 260° C. to 455° C., (2) a system pressure in the range 13 to 130 atmospheres, (3) a feed rate in the range 0.1–10.0 V/V/Hr, (4) a hydrogen gas ratio in the range 89 to 1789 SCM/KL, and (5) one or more typical process stages using the same or a different catalyst in each stage.

The sulfur-reduced oil feedstocks suitable for the process herein contain an appreciable nitrogenous impurity component. This component, calculated as nitrogen, is usually present in the oil in parts by weight in an amount in the range of from about 10 to 1000 parts per million (ppmw) of the feedstock. The nitrogen-containing compounds making up this nitrogenous component of the oil are residual compounds and comprise nitrogen compounds which are the more stable of those normally indigenous to petroleum and syncrude oils because they have remained present in the oil even after contact thereof with hydrogen gas under hydrodesulfurizing conditions. Consequently, removal of these residual compounds from the oil presents a problem to a refiner of oil. Desirably, the nitrogen content of an oil should be minimal, especially where the oil is to be burned as fuel or the like. For example, organic nitrogen compounds produce nitrogen oxides in typical fuel burnings. Nitrogen oxides in combustion gases are, of course, a known source of atmospheric smog.

By "liquid-liquid extracting conditions" as used herein is meant, by definition, ordinary known conditions therefor, including the use of (1) at least sufficient of the extracting liquid to provide separate extract and raffinate phases, and (2) a combination of temperature and pressure at least sufficient to maintain said liquid phases.

Any suitable form of apparatus may be used. In general, the various means customarily employed in extraction processes to increase the contact area between the oil stock and the solvent can be employed. Thus, the apparatus used in the present process can comprise a single extraction zone or multiple extraction zones equipped with (a) shed rows or stationary devices to facilitate contacting; (b) orifice mixers; or (c) effective stirring devices such as mechanical agitators, jets of restricted internal diameter, turbo mixers and the like. The operation may be conducted in the batch or continuous-type manner, with the latter being preferred. A continuous countercurrent operation is a preferred mode, for example, a mode similar to that described in U.S. Pat. No. 3,205,167 (J. Demeester). Known techniques for decreasing the solvent selectivity of the extracting solvent for hydrocarbons can be employed. Examples of these are the use of small amounts of antisolvents, e.g., water, during the extraction of the oil with the organic solvent, operating at fairly low temperatures sufficient to effect the desired extraction objective, and using low solvent-to-oil ratios.

EMBODIMENT

In a preferred embodiment, a hydrodesulfurized vacuum gas oil is treated. A typical such oil has a sulfur content of about 0.1 weight percent and a nitrogen content of about 1140 ppmw. Under ambient conditions of temperature and pressure, this feedstock is extracted in a countercurrent liquid-liquid extracting tower operating at a solvent-to-oil ratio of about 0.5. Using a furfural solution of ferric chloride containing about 0.2 weight percent of $FeCl_3.6H_2O$ as the extracting medium and, if desired, with prior equilibration of the feedstock with the extracting solvent, for example, by contacting the feedstock with the extract phase of a downstream extractor, a raffinate oil phase having a nitrogen content of about 100 ppmw is produced. The estimated yield of extracted oil, based upon feedstock, exceeds 98%. After removal of a minor amount of furfural from the raffinate phase, for example, by water washing or fractionating, the recovered oil is especially upgraded, for example, for use as a fuel for a furnace.

FEEDSTOCK

Hydrodesulfurized oils, in general, are upgraded by the process herein and are contemplated for use as feedstocks. Preferred oils have a residual nitrogenous component content, calculated as nitrogen, in the range of from about 10 to 1000 ppmw, more preferably 25 to 400 ppmw. Best results, from an overall processing and cost viewpoint, are believed to be achieved when the residual nitrogen content is in the range below 500 ppmw, preferably below 250 ppmw.

Representative hydrodesulfurized oils contemplated for use herein include syncrude oils, that is oils obtained by hydrodesulfurizing hydrogenated carbonaceous materials, such as coal, tar sand oil, shale oil, and the like; hydrodesulfurized petroleum distillates such as vacuum gas oils and fractions thereof, and hydrodesulfurized coke oven distillates, such as creosote-type oils, and the like oils resulting from pyrolyzing and hydrodesulfurizing a carbonaceous material, and mixtures of the aforementioned oils. Oils commonly referred to as synthetic crude oils, syncrudes, and vacuum gas oils are preferred feedstock oils for the present process.

In addition to the aforementioned nitrogenous component, the feedstocks herein may contain minor amounts of aromatic hydrocarbons, residual sulfur-containing (chemically bound sulfur) hydrocarbons, and polycyclic hydrocarbons.

EXTRACTING MEDIUM

Conventional extraction liquids have been found to be unsatisfactory for removing residual nitrogenous contents from a hydrogenated oil. For example, furfural was found to be ineffective in extracting an oil containing about 70 ppmw of residual nitrogen compounds. Thus, after 3 extraction stages using furfural solvent and a 1-to-1 solvent-to-oil volumetric ratio, only about 56% of the nitrogenous component had been removed. This is surprising in view of prior art teaching, for example in British Pat. No. 943,239 or in a paper in "Chem. Age. Ind.", Vol. 25, 103 (1974), by M. and A. Mukhopadhyay. On the other hand, in the present process, when the extraction was carried out under the same conditions except that furfural containing about 5 weight percent of ferric chloride was used as the extracting phase, at least 99% of the residual nitrogenous components of the oil was removed. This is a surprising and useful result, especially in view of the fact that no precipitate was formed (see, for example, U.S. Pat. Nos. 2,780,582, 2,796,387 and 3,193,496) and little, if any, concurrent polymerization of the furfural solvent occurred. Ferric chloride promotes the extraction by furfural of the residual nitrogenous component of a hydrodesulfurized oil.

At least a major portion of the extracting liquid should be furfural. Thus, when the above-described extraction is carried out under the same conditions except that 50 volume percent of the furfural is replaced by methanol, only about 93% of the nitrogenous component had been removed. The comparative results were as follows:

| Solvent | N Content of Product (ppmw) | Denitrogenation, % |
|---|---|---|
| 5% $FeCl_3 . 6H_2O$ in Furfural | 0.9 | 99 |
| 5% $FeCl_3 . 6H_2O$ in 50/50 Furfural-MeOH | 4.8 | 93 |

Undiluted furfural is therefore superior to diluted furfural as an extracting medium. Preferably the organic solvent employed for the process herein contains a major portion of furfural, more preferably at least about 80 volume percent of furfural, and most preferably consists essentially of furfural. Where a diluted solvent is to be used, the diluent is desirably a lower ($C_1$–$C_3$) alkanol, for example methanol, ethanol, and the like relatively polar organic compounds.

The furfural solvent used in the process may be recovered by any suitable known method, for example using a distilling method as described in "Ind. Eng. Chem.", 40, 220 (1949), and "Encyclopedia of Chemical Technology", Kirk-Othmer, 2nd Ed., Vol. 18, pp. 549–564.

$FeCl_3$EXTRACTION PROMOTER

The amount of ferric chloride desirably present in the extracting medium varies, depending in the main upon the amount of nitrogenous component present in the oil feed. The amount of ferric chloride in the furfural extracting solution should be, based by weight upon the solution, in the range from about 0.001 to 10, preferably 0.01 to 5, and more preferably about 0.2 to 2 percent.

EXAMPLES 1–3

Under ambient conditions of temperature and pressure, that is, about 20° C. and 1 atmosphere pressure, aliquots of the hydrodesulfurized vacuum gas described above were extracted with furfural with the following results:

| | Extracting | | Raffinate Phase | |
|---|---|---|---|---|
| Ex. No. | Solution wt. % $FeCl_3 . 6H_2O$ | Solvent-Oil Vol. Ratio | % Oil Recovery | N-Content, ppmw |
| 1 | None | 1.0 | 90 | 505 |
| 2 | 1.0 | 0.5 | 90 | 395 |
| 3 | 1.0 | 0.25[1] | 95 | 320 |

[1]two extraction stages, S/O volume ratio in each 0.25 with overall S/O volume ratio of 0.5.

These data demonstrate that ferric chloride promoted furfural extraction effectively reduces the nitrogenous impurity content of a hydrodesulfurized hydrocarbonaceous oil.

What is claimed is:

1. In a process for upgrading a hydrocarbonaceous oil wherein said oil is hydrodesulfurized under hydrocarbon hydrodesulfurizing conditions, thereby producing a sulfur-reduced oil contaminated by residual nitrogen-containing impurities, calculated as nitrogen, in an amount in the range of from about 10 to 1000 ppmw, the improvement comprising:

(1) upgrading at least a fraction of said sulfur-reduced oil by contacting said fraction with a solution of ferric chloride, said contacting being under liquid-liquid extracting conditions, including (a) a temperature in the range of from about 0° to 50° C. and (b) a solution-to-oil volume ratio in the range of from about 0.1 to 5, said solution comprising (i) at least a major portion of furfural solvent and (ii) said ferric chloride in an amount by weight, based upon the solution, in the range of from about 0.001 to 10 percent, thereby forming a raffinate oil phase containing a minor portion of said nitrogenous impurity; and (2) withdrawing said raffinate oil phase from step (1).

2. A process as in claim 1 wherein (1) said nitrogen-containing impurities content is below about 500 ppmw, (2) said contact temperature range is 10° to 40° C., (3) said solution consists essentially of furfural, and (4) said amount of ferric chloride is in the range 0.01 to 5 percent.

3. A process as in claim 1 wherein said amount of ferric chloride is in the range 0.2 to 2 percent.

4. A process as in claim 1 wherein said amount of nitrogen-containing impurities is below about 250 ppmw.

5. A process as in claim 1 wherein said solution contains a minor amount of a lower alkanol.

6. A process as in claim 1 wherein said oil is a vacuum gas oil.

7. A process as in claim 1 wherein said oil is syncrude oil.

8. A process as in claim 1 wherein said oil is a coke oven distillate.

9. A process as in claim 1 wherein said contacting is in countercurrent flow of said oil and said solution.

* * * * *